US005690388A

United States Patent [19]

Saiger

[11] Patent Number: 5,690,388

[45] Date of Patent: Nov. 25, 1997

[54] METHODS OF MAKING A FURNITURE PRODUCT AND THE PRODUCT FORMED THEREBY

[75] Inventor: Herbert C. Saiger, Troy, Ohio

[73] Assignee: Woodard, Inc., Owosso, Mich.

[21] Appl. No.: 733,785

[22] Filed: Oct. 18, 1996

[51] Int. Cl.[6] ..... A47C 1/12

[52] U.S. Cl. ..... 297/447.2; 297/451.11

[58] Field of Search ..... 297/DIG. 2, 452.36, 297/452.33, 452.34, 452.18, 451.11, 451.12, 447.2, 447.1, 446.1, 451.9, 452.64, 452.63, 452.55, 452.56; 29/428, 446

[56] References Cited

U.S. PATENT DOCUMENTS

| | | | |
|---|---|---|---|
| 1,555,377 | 9/1925 | Knoll | 297/452.64 |
| 2,642,118 | 6/1953 | Lamb | 297/447.2 X |
| 3,328,084 | 6/1967 | Whitener et al. | 297/446.1 |
| 4,062,590 | 12/1977 | Polsky et al. | 297/452.64 X |

FOREIGN PATENT DOCUMENTS

| | | | |
|---|---|---|---|
| 106931 | 12/1963 | Netherlands | 297/446.1 |
| 438465 | 11/1935 | United Kingdom | 297/446.1 |

OTHER PUBLICATIONS

Woodard Catalog–1994–Valencia pages.

Woodard Catalog–1994–Briarwood pages.

*Primary Examiner*—Milton Nelson, Jr.
*Attorney, Agent, or Firm*—Learman & McCulloch

[57] ABSTRACT

A method of making a new furniture product, such as a chair, with front and rear legs supporting a seat frame and a U-shaped back and arm rest frame assembly. The seat frame has an inwardly extending perimetral flange and a vertical flange. The back and arm rest frame assembly has a vertical flange generally aligned with the vertical flange of the seat frame. The method includes the steps of laterally compressing a resilient plastic back shell having a curvilinear back portion and forwardly extending side portions and positioning the shell within the seat frame. The compression is than released to permit the shell to expand laterally into bearing engagement with the seat frame and the back and arm rest frame assembly vertical flanges. Then a seat is provided for the seat frame.

17 Claims, 6 Drawing Sheets

METHODS OF MAKING A FURNITURE PRODUCT AND THE PRODUCT FORMED THEREBY

BACKGROUND OF THE INVENTION

The present invention is concerned with casual furniture of the type which is generally used in outdoor settings, such as around pools and on patios, particularly, but which also is used in other casual furniture settings as well. The invention is concerned with a method of making a furniture product such as a barrel chair which, typically, is sold as part of a grouping of furniture of a particular ornamental appearance and incorporates an upholstered seat. The chair which will be specifically disclosed belongs to a grouping known as a cushion group, as distinguished from sling groups and strap groups.

SUMMARY OF THE INVENTION

The invention is concerned with a chair having a frame which is so constituted as to provide perimetral flanges for trapping a curvate back shell component having a preformed curvilinear back section with integral forwardly extending side portions. The shell is formed of a material having a plastic memory and is laterally compressed to fit within the flanges and be retained by the propensity of the back component to return to uncompressed condition. With the back component thus held in position, a drop-in seat, which carries a cushion material, is inserted and has sufficient rigidity to lock the back shell component in position. An upwardly extending arm rest and back frame has an upper flange for restraining the back shell component and a seat frame has an inwardly extending perimetral flange on which the seat rests. At the front end of the furniture product, the front legs extend upwardly to merge with the curvilinear arm rest and back frame and provide a perimetral flange for restraining the front edges of the side portions of the laterally compressible shell.

It is a prime object of the present invention to provide a furniture product of the character described which can be economically manufactured and readily assembled with a choice of a wide variety of back and seat component facings or designer fabrics.

Still another object of the invention is to provide a furniture product having a frame which can be constructed of a lightweight material such as aluminum extrusions, welded together to provide a strong and durable furniture product which can be electrostatically coated with pigmented polyester powder fused to the frame to withstand outdoor temperature and weather conditions.

Still another object of the invention is to provide a method of producing a quality chair which has readily disassemblable and replaceable back and upholstered seat components which permit the ready changing of the appearance of the chair when it is desired to present a different look, or to replace a seat or back which has been inadvertently damaged.

Another object of the invention is to provide a furniture product which is tough and durable and will not be deteriorated by exposure to ultraviolet rays and moisture.

Other objects and advantages of the invention will become apparent with reference to the accompanying drawings and the accompanying descriptive matter.

GENERAL DESCRIPTION OF THE DRAWINGS

SPECIFIC DESCRIPTION OF THE DRAWINGS

Figure 9:
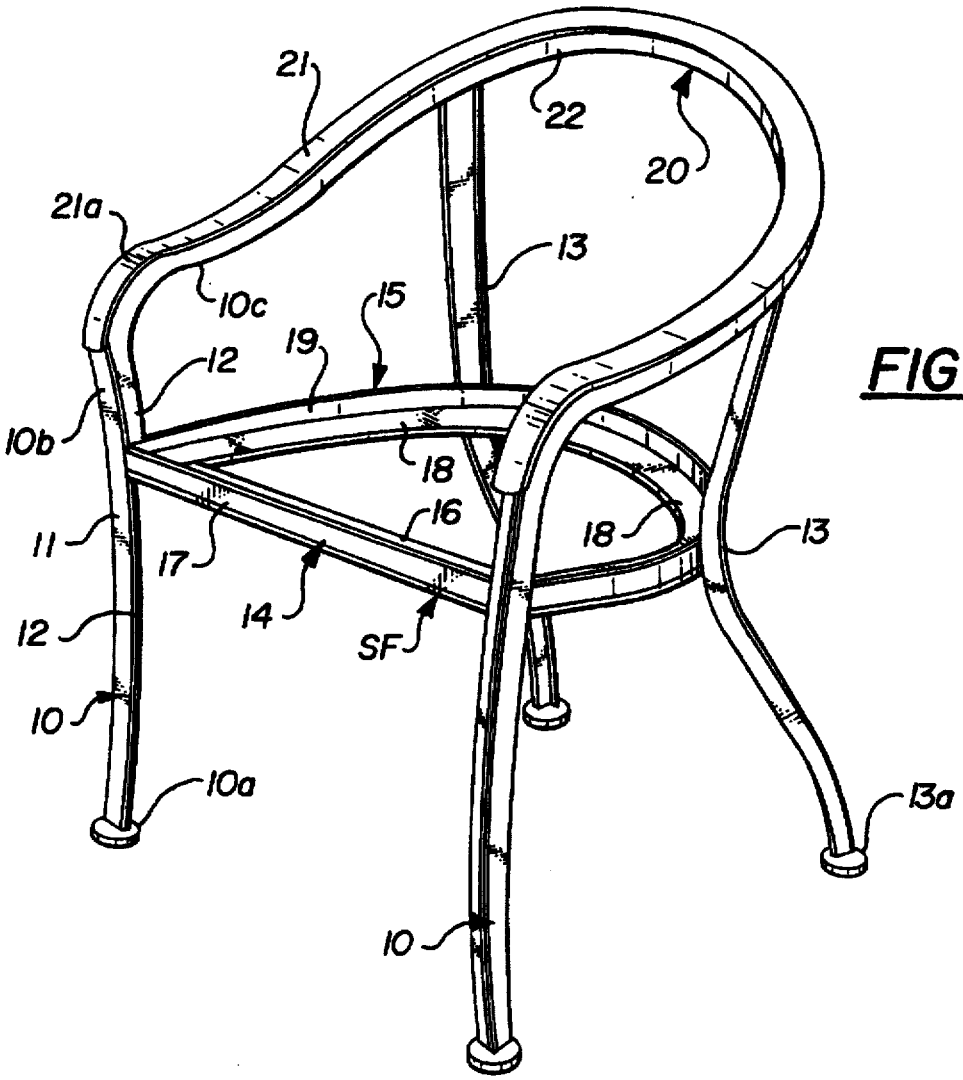
FIG. 9 is a schematic front perspective elevational view of the prefabricated chair frame only.

Referring now more particularly to the accompanying drawings, and in the first place particularly to FIG. 9 thereof, it will be seen that the barrel chair frame which is depicted includes tapering front legs of right angular section generally designated 10, with footpads 10*a*, joined to a seat frame generally designated SF. Front legs 10 have upper sections 10*b* which extend vertically and then rearwardly as at 10*c* (see particularly FIGS. 4 and 6). The legs 10 have laterally inwardly extending vertically disposed front flanges 11 joined to vertically extending side flanges 12.

The seat frame SF, which is also supported by rear right angular legs 13 with footpads 13*a*, includes a frontal portion, generally designated 14, connecting the legs 10, joined with a curvilinear U-shaped seat portion, generally designated 15, which is of the same cross section as the legs 10. The frontal section 14 includes an inwardly extending perimetral flange 16 and a vertically extending perimetral flange 17, whereas the portion or section 15 includes an inwardly extending flange 18 functioning as a continuation of flange 16 and a vertically disposed flange 19 which aligns with and functions as a continuation of the flanges 12 of legs 10.

Figure 4:
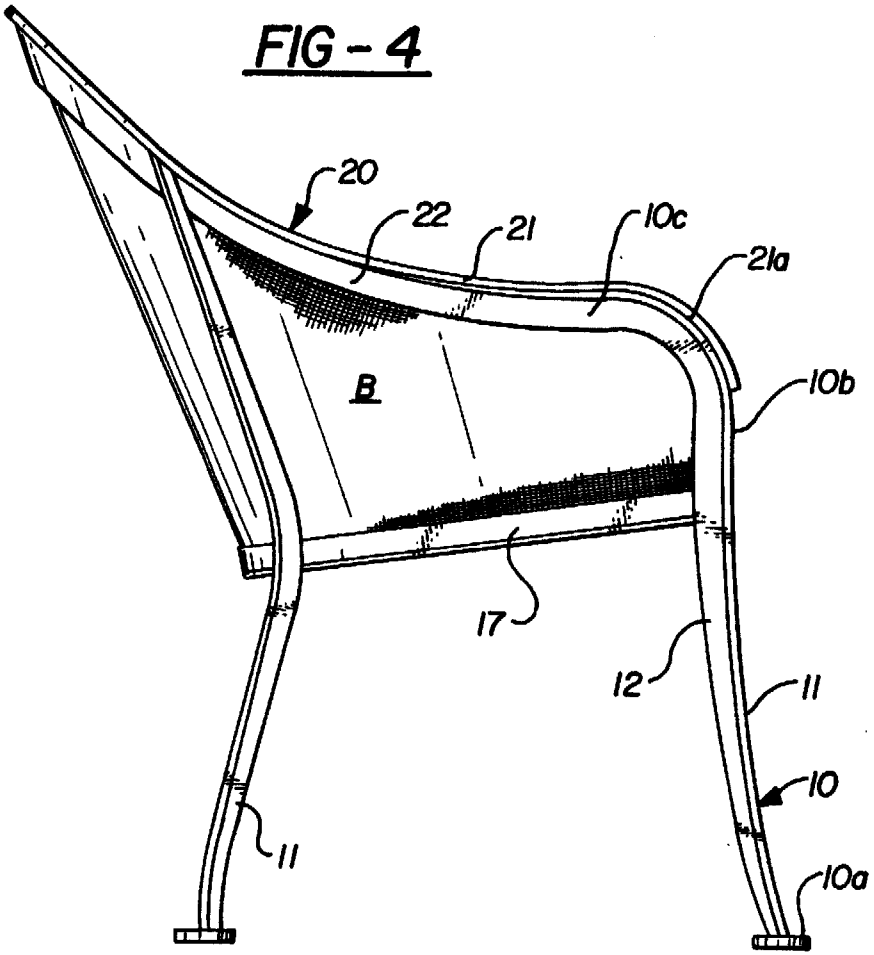
FIG. 4 is a side elevational view thereof.
Figure 3:
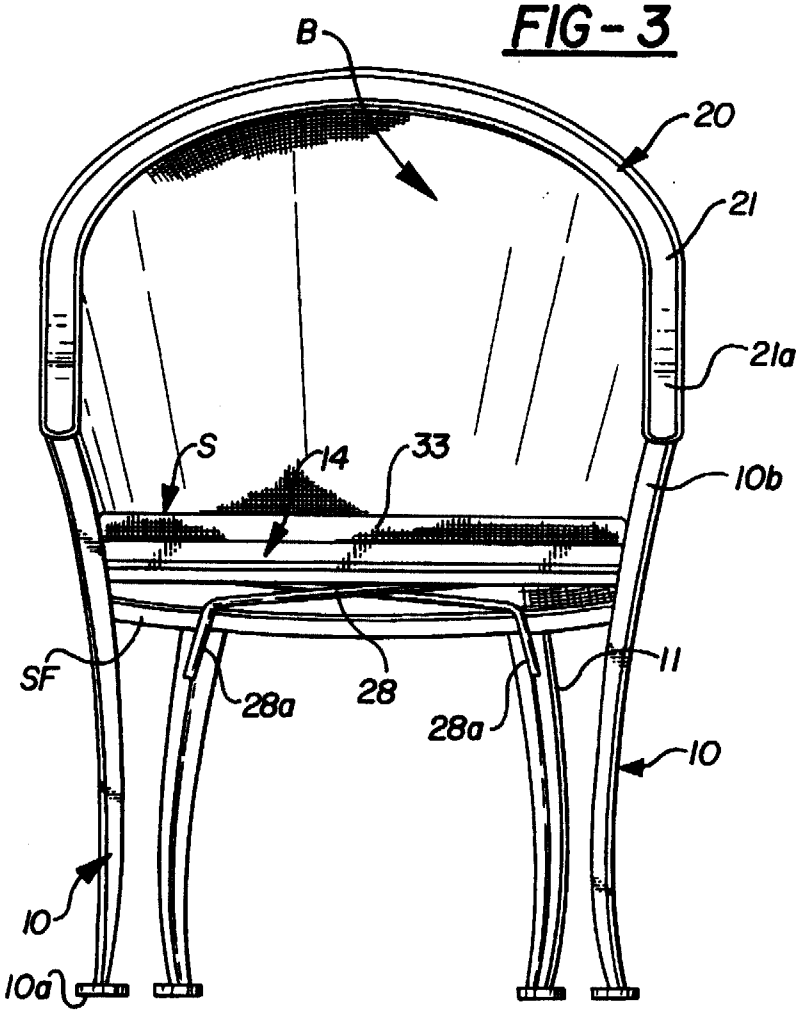
FIG. 3 is a front elevational view thereof.
Figure 6:
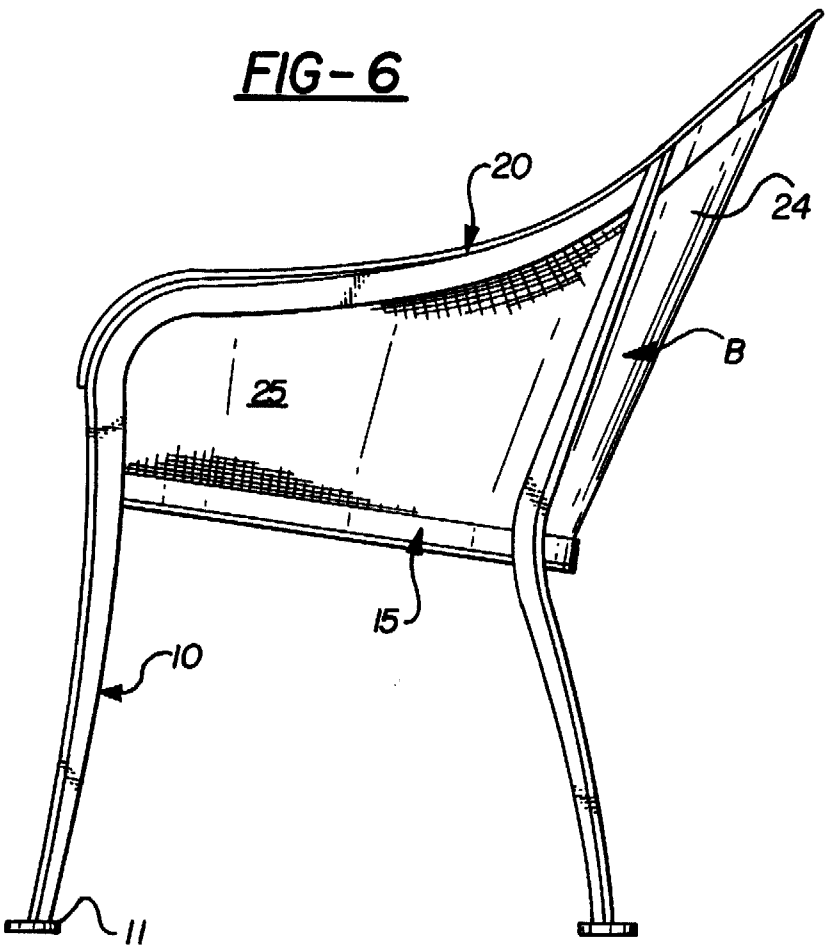
FIG. 6 is an opposite side elevational view thereof.
Figure 5:
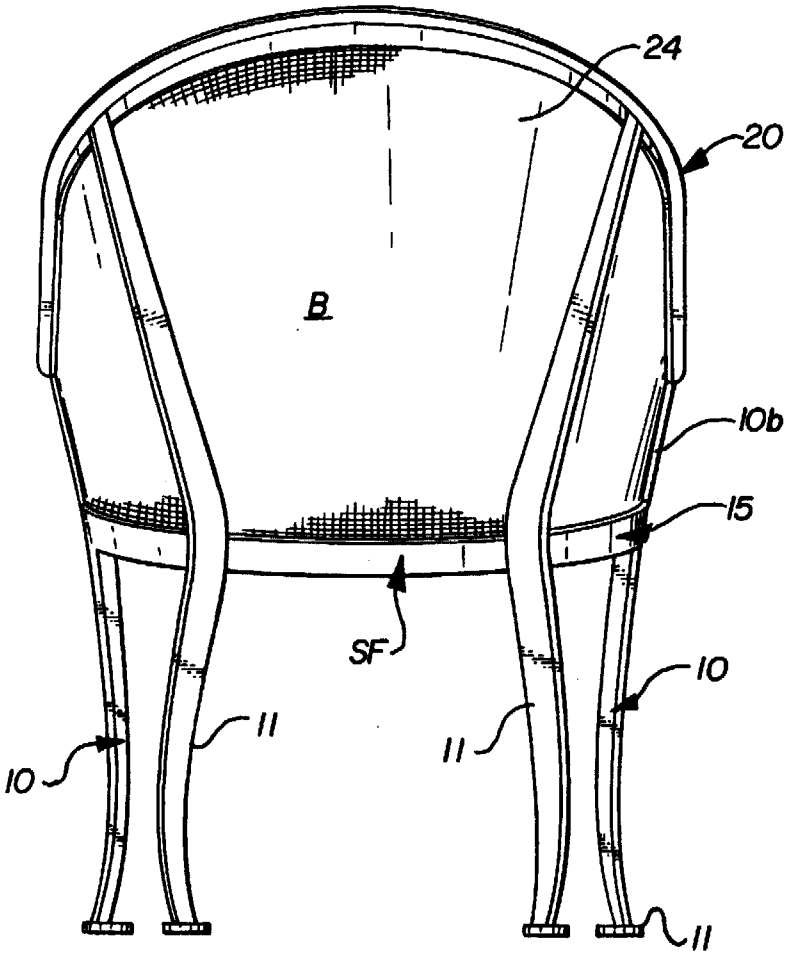
FIG. 5 is a rear elevational view thereof.
Figure 8:
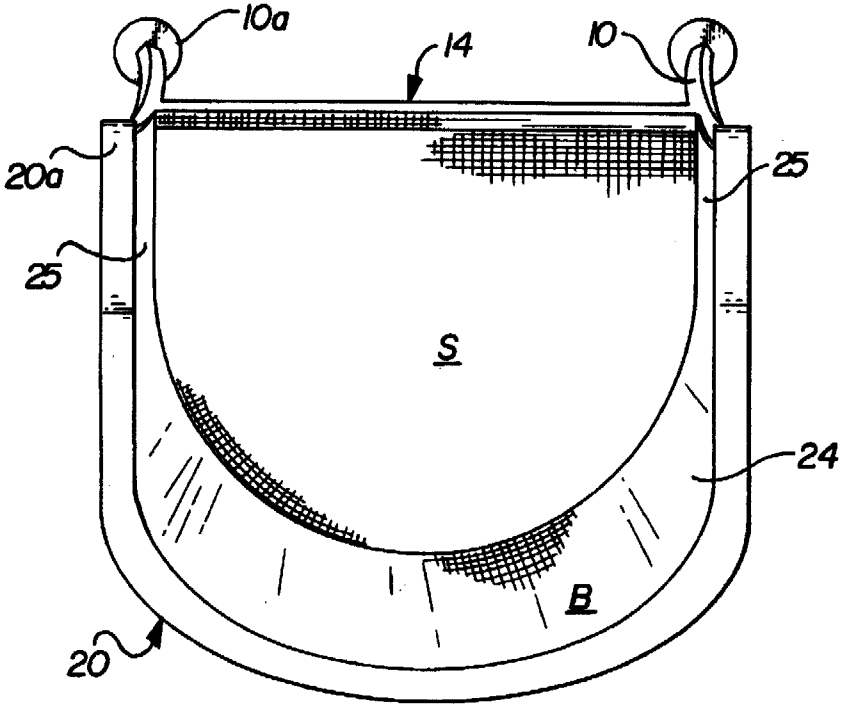
FIG. 8 is a top plan view thereof.
Figure 12:
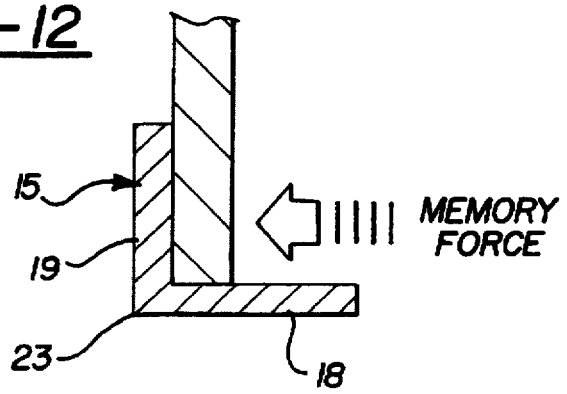
FIG. 12 is a greatly enlarged fragmentary sectional view taken on line 12—12 of FIG. 11.

Welded to the portions 10*c* and 10*b* of the front legs 10, is a U-shaped in plan, curvate back and armrest frame or frame assembly, generally designated 20, which includes a perimetral top wall flange 21 and a downwardly extending perimetral flange 22 which is in general vertical alignment with the flanges 12 and 19. The front portions 21*a* of the arm rest flanges 21 lap, and are welded to, the frontal portions 10*c* of the legs 10 at their upper ends as these portions curve rearwardly, as shown in FIGS. 4 and 6. Attention is now directed to FIG. 12 in particular, since it is to be understood that the frame cross section member 15 depicted, which is provided with an ornamental bead 23, illustrates the cross section of legs 10, seat frame SF, and arm rest and back frame 20, as well. The various flanges provide horizontal or vertical surfaces.

Figure 10:
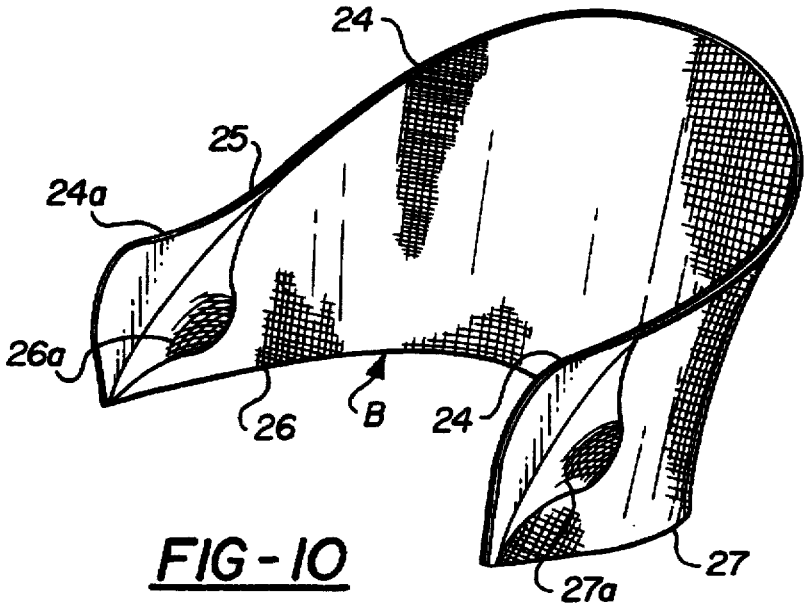
FIG. 10 is a schematic, front perspective elevational view of the back component or shell with facing portions folded back to indicate the manner in which facings are applied to the interior and exterior sides thereof.
Figure 11:
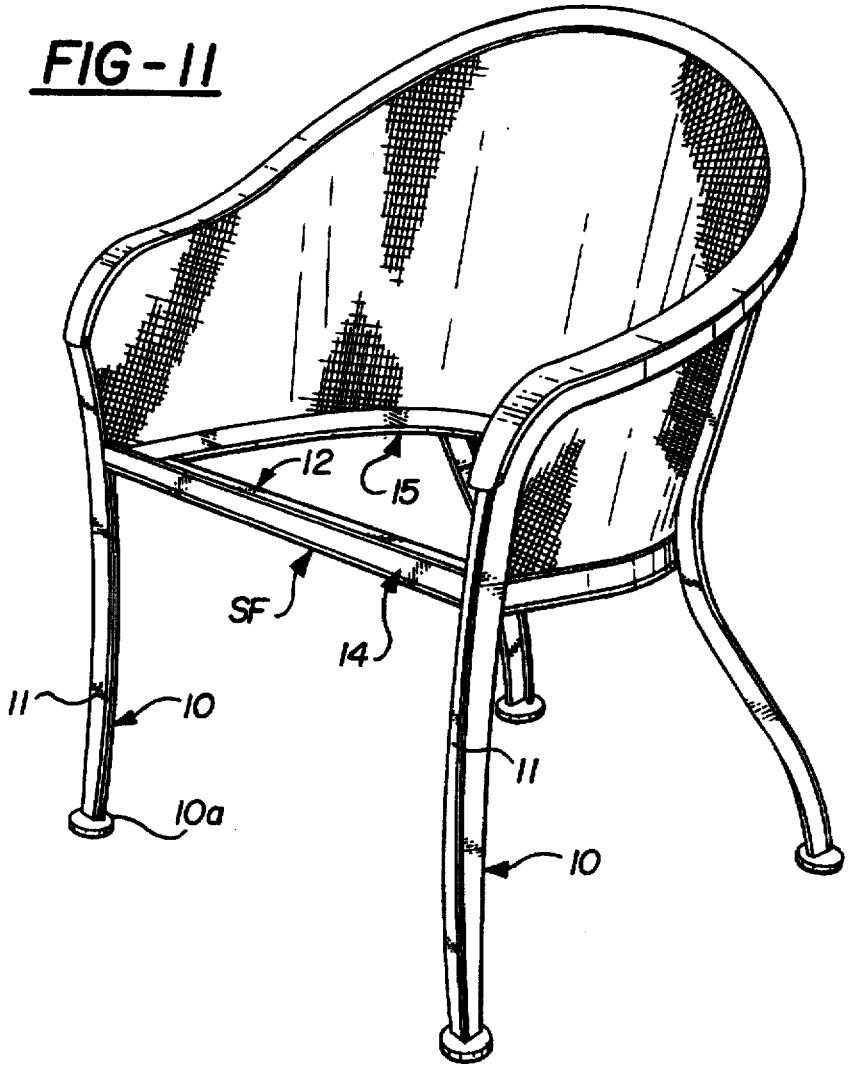
FIG. 11 is a perspective elevational view showing the chair frame with the back shell installed.

FIG. 10 particularly illustrates the back shell component or shell, generally designated B, which is formed of a high strength, high molecular weight polyethylene or other suitable plastic which is flexible and resilient and has a plastic memory returning it to original or normal unstressed condition, if it is not deformed beyond its elastic limit. Polyethylene is a preferred material for economic reasons, but it is thought that other polyolefins such as polypropylene, and other plastics such as polycarbonates and polyacrylics may also be used, because they will function well to provide the structural characteristics which are desired.

In FIG. 10, the back shell or back shell component B is shown as having a curvate back section or portion 24 with forwardly extending side sections or portion 25. The polyethylene shell depicted is heat formed before application of a facing to both inner and outer faces which can be a suitable fabric such as a woven acrylic, or a vinyl cane, or a foam sandwiched between a pair of plastic sheets. It is formed of a vacuum formable material which is cut to shape, heated to render it deformable, and placed in a mold of the desired shape for cooling. Typically, it has a thickness of about one quarter of an inch.

In FIG. 10, an interior facing 26 is shown as having its upper front edge 26*a* peeled back from the polyethylene core shell B. Likewise, the exterior facing 27 is shown as having an edge 27*a* peeled back from the core shell B, for purposes of illustration. Facings 26 and 27 are preferably adhesively adhered to the shell 24 with a suitable commercial adhesive, of which many are available.

FIG. 10 portrays the uncompressed normal configuration of the shell B. The material is resilient and can be compressed sufficiently by laterally compressing the arm sections 25 toward one another, which also has the effect of narrowing the curvilinearity of the loop shape of the curvate back portion 24. When the shell or back component B is then placed within the vertical flanges 19, 22, 17 and 11 in compressed condition to rest on the generally horizontal flanges 16 and 18 and the compressive forces are released, side sections 25 will tend to expand laterally outwardly toward uncompressed condition and the curvate back portion 24 will also expand its loop or curve to tend to return to unstressed condition. The flanges 19, 12 and 22 prevent this from fully occurring and the flanges 11 and 17 prevent any forward movement of the shell component B.

Figure 2:
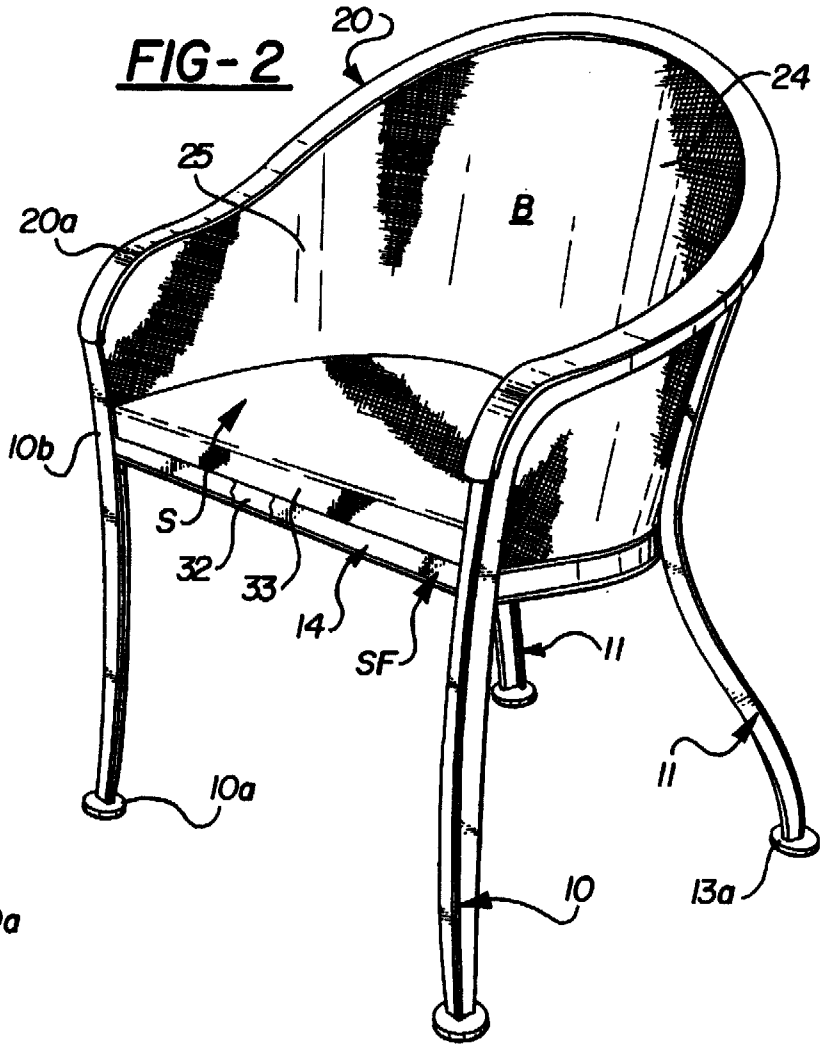
FIG. 2 is a front perspective elevational view thereof.
Figure 1:
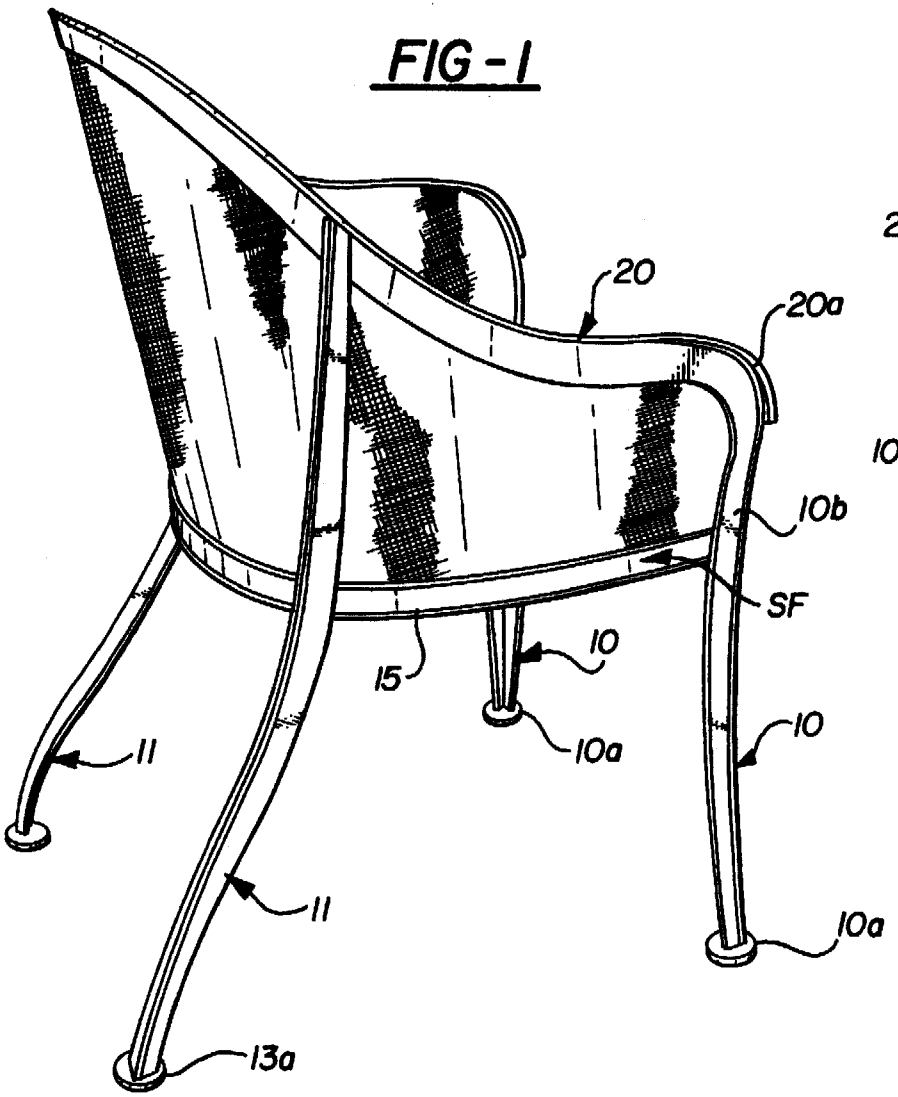
FIG. 1 is a rear perspective elevational view of a barrel chair constructed according to the method of the invention.
Figure 7:
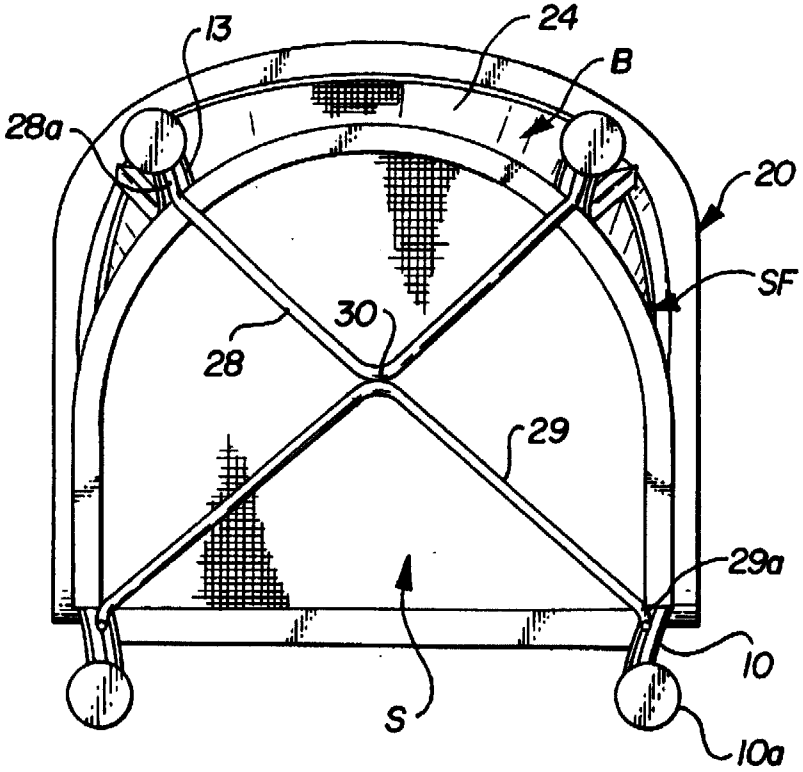
FIG. 7 is an under plan view thereof.

FIG. 7, in particular, illustrates a pair of seat frame supports 28 and 29 which may be centrally welded together at 30, and which at their ends are angled downwardly and welded to front legs 10 as at 29*a*, and to rear legs 13 as at 28*a*. With the seat support members 28 and 29 fixed in place, a drop in seat, generally designated S, can be dropped in position inboard of the shell back component B to function as a lock. The seat S has a generally rigid bottom wall 32 (FIG. 2) which supports a cushion 33 with sufficient thickness to provide a very comfortable seat. It is to be understood that, when inserted, the front of the seat S is trapped by the flanges 14 and 11 frontally and by the flange 19, and is of a size such that wall 32 snugly engages the walls of the back component B around the perimeter of the back component B. The wall 32 may be formed of the same plastic material as back B and faced with the same material exteriorly.

THE ASSEMBLY

The foregoing description indicates the method and order of assembly. Typically, the aluminum furniture frame, as depicted in FIG. 9, will be supplied with its pigmented coating in an attractive color. The back component or shell B will be one of a number of such faced back components which are available to match or coordinate with the particular color chosen for the chair frame. When back component B is chosen, it may be compressed and dropped into position as has been indicated. Finally the seat S which is chosen will be the same as, or match the interior and exterior facings 26 and 27. A wide variety of designer fabrics and colors is available to provide a chair of extremely attractive and elegant appearance.

The disclosed embodiment is representative of a presently preferred form of the invention, but is intended to be illustrative rather than definitive thereof. The invention is defined in the claims.

I claim:

1. In a method of making a furniture product having a frame comprising front and rear legs supporting a seat frame, the front legs having leg portions extending upwardly above the seat frame, and a generally U-shaped integrated, back and arm rest frame assembly; the seat frame being formed with inwardly extending generally horizontal perimetral flange surfaces and upwardly extending vertical flange surfaces, and the back and arm rest frame assembly being formed with inwardly extending upper flange surfaces and downwardly extending vertical flange surfaces generally vertically aligned with the upwardly extending flange surfaces of said seat frame, the steps of:

a) exerting compressive force to laterally compress a back shell component having a curvilinear back portion with forwardly extending side portions, the back portion and side portions being configured and vertically sized to fit between the inwardly extending flange surfaces of said back and arm rest frame assembly and the inwardly extending flange surfaces of the seat frame, the back shell component being formed of a resilient plastic material with a plastic memory which returns it to its uncompressed configuration, b) positioning said back shell component on said inwardly extending flange surfaces of said seat frame within said upwardly extending flange surfaces of said seat frame and said downwardly extending flange surfaces of said back and arm rest frame assembly and releasing the said compressive force exerted to permit the back shell component to expand laterally into engagement with said seat frame and back arm rest frame assembly vertical flange surfaces, the shape of the back portion in uncompressed condition causing the back shell component to bear against the said vertical flange surfaces of the seat frame and said back and arm rest frame assembly which hold said back shell component from returning to completely uncompressed condition; and (c) inserting a laterally rigid seat part to a position resting on the inwardly extending flange surfaces of said seat frame to lock the back shell component in place, the seat part being sized to substantially engage the back portion and side portions of the said back shell component.

2. The method of claim 1 wherein said leg portions of said front legs are formed with vertically extending flange portions, generally vertically aligned with said seat frame vertical flange surfaces, and with vertical frontal flange portions, and said side portions of the back shell component are frontally trapped by the said frontal flange portions of said leg portions of the front legs when said back shell component is positioned.

3. The method of claim 1 wherein prior to inserting said back shell component, said back shell component is faced with an interior and exterior facing material.

4. The method of claim 3 wherein said facing material is one of a vinyl cane sheet, a sheet structure having a foam layer, or a woven fabric.

5. The method of claim 1 wherein said arm rest and back frame assembly has top flange portions curved upwardly in a front to rear direction to form arm rests.

6. A furniture product comprising:

a) a frame with front and rear legs supporting a seat frame, the front legs having leg portions extending upwardly above the seat frame;

b) a generally U-shaped back and arm rest frame fixed to and supported by the front and rear legs;

c) the seat frame being formed with inwardly extending, generally horizontal perimetrally positioned flange surfaces and perimetrally positioned vertical flange surfaces;

d) the back and arm rest frame being formed with inwardly extending, generally horizontal, upper flange portions and downwardly extending vertical flange portions generally aligned with said perimetrally positioned vertical flange surfaces of the seat frame;

e) a laterally compressed back shell component having a curvilinear back portion with forwardly extending side portions, the back portion and side portions being configured and vertically sized to span said downwardly extending flange portions of the back and arm rest frame and the said perimetrally positioned vertical flange surfaces of the seat frame, the back shell component being formed of a resilient plastic material with a plastic memory which seeks to return to uncompressed configuration and bears against the vertical flange surfaces of the seat frame, and the downwardly extending flange portions of the arm rest and back frame, and;

f) a seat member with a rigid perimetral frame part resting on the said generally horizontal flange surfaces of the seat frame and engaging the back and side portions of the back shell component.

7. The furniture product of claim 6 wherein said leg portions of the front legs are formed with upwardly vertically extending flange portions aligned with said seat frame vertical flange surfaces, and said leg portions have vertical frontal flange portions, and the side portions of the back shell component are frontally trapped by the vertical frontal flange portions of said leg portions of the front legs.

8. The furniture product of claim 7 wherein the back shell component has interior and exterior faces which are faced with an attractive facing material.

9. The furniture product of claim 7 wherein said frontal flange portions of the leg portions of the front legs curve rearwardly and merge with said upper flange portions of the back and arm rest frame assembly.

10. The furniture product of claim 6 wherein said side portions of the back shell component converge vertically slightly to the seat frame and the back portion of the back shell component slopes inwardly to the seat frame from above.

11. The furniture product of claim 6 wherein said seat frame is an angle in cross-section.

12. In a method of making a furniture product having a frame comprising front and rear legs supporting a seat frame, the front legs having leg portions extending upwardly above the seat frame, and a generally U-shaped, integrated back and arm rest frame assembly; the seat frame being formed with perimetrally positioned vertical surfaces and generally horizontal perimetrally positioned surfaces extending inwardly of said vertical surfaces; the back and arm rest frame assembly being formed with vertical surfaces generally vertically aligned with the said vertical surfaces of said seat frame, the steps of:

a) exerting compressive force to laterally compress a back shell component having a curvilinear back portion with forwardly extending side portions, the back portion with side portions being configured and vertically sized to span the vertical surfaces of said back and arm rest frame assembly and the said vertical surfaces of the seat frame, the back shell component being formed of a resilient material with a plastic memory which returns it to its uncompressed configuration, b) positioning said back shell component within said vertical surfaces of said seat frame and releasing the said compressive force exerted to permit the back shell component to expand laterally into engagement with said seat frame and back and arm rest frame assembly vertical surfaces, the shape of the back shell portion in uncompressed condition causing the back shell component to bear against the said vertical surfaces of the seat frame and said back and arm rest frame assembly which hold said back shell component from returning to completely uncompressed condition; and c) inserting a drop-in seat part to a position resting on the inwardly extending surfaces of said seat frame, the drop-in seat part being sized to substantially engage the back portion and side portions of the said back shell component.

13. The method of claim 12 wherein the leg portions of said front legs have inwardly extending vertical frontal surfaces, and said side portions of the back shell component are frontally trapped by the said inwardly extending frontal surfaces of said leg portions of the front legs when said back shell component is positioned.

14. A furniture product comprising:

a) a frame with front and rear legs supporting a seat frame, the front legs having leg portions extending upwardly above the seat frame;

b) a generally U-shaped back and arm rest frame fixed to and supported by the front and rear legs;

c) the seat frame being formed with perimetral vertical surfaces and inwardly extending, generally horizontal, perimetrally positioned surfaces;

d) the back and arm rest frame being formed with vertical surfaces generally aligned with said perimetral vertical surfaces of the seat frame;

e) a laterally compressed back shell component having a curvilinear back portion with forwardly extending side portions, the back portion with side portions being configured and vertically sized to span said vertical surfaces of the back and arm rest frame and the said perimetral vertical surfaces of the seat frame, the back shell component being formed of a resilient material with a plastic memory which seeks to return to uncompressed configuration and bears against the said vertical surfaces of the seat frame, and the vertical surfaces of the arm rest and back frame; and f) a seat part supported by the said generally horizontal surfaces of the seat frame to lie adjacent the back and side portions of the back shell component.

15. The furniture product of claim 14 wherein said leg portions of the front legs are formed with vertically extending portions aligned with said seat frame vertical surfaces and said leg portions have inwardly extending vertical frontal portions, and the side portions of the back shell component are frontally trapped by the said vertical frontal portions of said leg portions of the front legs.

16. The furniture product of claim 14 wherein said seat part includes a cushion part resting on a rigid bottom supported by said seat frame generally horizontal surfaces.

17. The furniture product of claim 14 in which said back and arm rest frame has inwardly extending flange surfaces overlying said seat frame generally horizontal surfaces to capture the back shell component between them.

* * * * *